US009720352B2

(12) United States Patent
Tajiri et al.

(10) Patent No.: US 9,720,352 B2
(45) Date of Patent: Aug. 1, 2017

(54) IMAGE FORMING APPARATUS WITH ACCURATE POSITIONING OF SENSOR UNIT

(71) Applicant: CANON KABUSHIKI KAISHA, Tokyo (JP)

(72) Inventors: Tsuyoshi Tajiri, Tokyo (JP); Rin Ishikawa, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/065,063

(22) Filed: Mar. 9, 2016

(65) Prior Publication Data

US 2016/0187819 A1 Jun. 30, 2016

Related U.S. Application Data

(63) Continuation of application No. PCT/JP2014/074761, filed on Sep. 12, 2014.

(30) Foreign Application Priority Data

Sep. 13, 2013 (JP) ..... 2013-190280

(51) Int. Cl.
*G03G 15/01* (2006.01)
*G03G 15/16* (2006.01)
*G03G 15/00* (2006.01)

(52) U.S. Cl.
CPC ..... *G03G 15/1615* (2013.01); *G03G 15/0189* (2013.01); *G03G 15/5058* (2013.01)

(58) Field of Classification Search
CPC ..... G03G 15/1615; G03G 15/0189; G03G 15/5054; G03G 15/5058; G03G 21/168
USPC ..... 399/121, 301
See application file for complete search history.

(56) References Cited

U.S. PATENT DOCUMENTS 6,301,023 B1 10/2001 Hirai et al.
8,301,060 B2 * 10/2012 Mori ..... G03G 21/168 399/121
8,467,709 B2 * 6/2013 Kogure et al. ..... G03G 15/1615 399/301

(Continued)

FOREIGN PATENT DOCUMENTS

JP 11-65397 A 3/1999
JP 3473346 B2 3/1999

(Continued)

*Primary Examiner* — William J Royer
(74) *Attorney, Agent, or Firm* — Fitzpatrick, Cella, Harper & Scinto

(57) ABSTRACT

An image forming apparatus is designed to be capable of easily suppressing a variation of an inclination of a sensor relative to an endless belt and capable of high accuracy and stabilized sensing operation. The image forming apparatus includes a belt unit having an endless belt supported to be rotatable in a circumferential direction, an image forming unit for forming an image on the belt unit, and an optical sensor for detecting light projected onto the endless belt. The image forming apparatus further includes a sensor supporting member for supporting the sensor, and a positioning portion including, as a unit, a first positioning portion for positioning the belt unit by being contacted by the belt unit and a second positioning portion positioning the sensor supporting member by being contacted by the sensor supporting member.

18 Claims, 7 Drawing Sheets

(56) References Cited

U.S. PATENT DOCUMENTS

| | | | |
|---|---|---|---|
| 2004/0264988 | A1 | 12/2004 | Konishi |
| 2009/0245860 | A1 | 10/2009 | Mori |

FOREIGN PATENT DOCUMENTS

| | | | |
|---|---|---|---|
| JP | 11-220586 | A | 8/1999 |
| JP | 2002-131997 | A | 5/2002 |
| JP | 3462067 | B2 | 8/2003 |
| JP | 2003-248350 | A | 9/2003 |
| JP | 2004-125827 | A | 4/2004 |
| JP | 2004-326085 | A | 11/2004 |
| JP | 2009-134221 | A | 6/2009 |
| JP | 2009-237071 | A | 10/2009 |

* cited by examiner (a)

(b)

(a)

(b)

(a)

(b)

(c)

IMAGE FORMING APPARATUS WITH ACCURATE POSITIONING OF SENSOR UNIT

TECHNICAL FIELD

The present invention relates to an image forming apparatus such as a copying machine, a facsimile machine, a printing machine, and the like, which is structured so that a sensor can be accurately positioned relative to a belt unit such as an intermediary transfer belt unit of the apparatus.

BACKGROUND ART

In the field of an image forming apparatus which uses an electrophotographic image forming method, image forming apparatuses of a so-called intermediary transfer type, which form a full-color toner image on an intermediary transfer belt (ITB), are known. Among high speed image forming apparatuses of this type, some are enabled to keep their endless belt within a preset range in terms of the lengthwise direction of one of rollers by which the endless belt is suspended and kept tensioned (direction parallel to one of rollers), by detecting an amount of positional deviation of the endless belt such as the intermediary transfer belt, conveyance belt, and the like, and controlling the roller in alignment.

One of the primary problems which image forming apparatuses such as those described above suffer is color deviation attributable to the positional deviation of their endless belt in terms of a primary scanning direction, and a secondary scanning direction (parallel to belt conveyance direction), of a laser scanner, stretching or shrinking of toner image in terms of the primary scanning direction, angular deviation of toner image relative to the primary scanning direction, and the like. Another problem is that the apparatuses change in toner density due to inaccuracy in the components related to development, transfer, and the like, changes in ambient temperature and humidity, cumulative usage of apparatus, and the like factors, and therefore, the apparatuses become nonuniform in terms of image density.

Thus, some image forming apparatuses of the above-described type are structured to form a pattern to be used for compensating for color deviation density deviation, as means for measuring the amount of color deviation, on the intermediary transfer belt with preset intervals, detect the pattern with the use of a sensor, and correct the apparatuses in image formation position and image density. In the case of these apparatuses, in order to accurately detect the amount of color deviation and image density, the inaccuracy in the positional relationship between the endless belt and sensor has to be minimized.

In the past, there has been disclosed in Japanese Patent No. 3473346, for example, an apparatus structured so that a sensor of a reflection type is attached to a frame of a belt unit, and the frame is positioned relative to a shaft of an idler roller which is one of rollers by which an intermediary transfer belt is suspended and kept tensioned, with the placement of a positioning plate between the frame and the shaft (rotational axle) of the idler roller. According to this art, the belt unit is equipped with an endless belt such as an intermediary transfer belt, for example, and a preset detection mark (test patch) is formed on the endless belt by an image forming section. Then, the information which can be obtained by detecting the test patch with the use of an optical sensor is used.

According to the conventional arts which include the one described in Japanese Patent No. 3473346, the distance between the endless belt and the sensor of the reflection type can be kept stable with the use of the positioning plate. However, with the use of only the conventional arts, it is difficult to keep the sensor stable in its angle relative to the surface of the intermediary transfer belt, for the following reason. That is, the angle of the belt unit in terms of the direction indicated by a referential mark θ (angle of belt unit at plane perpendicular to shaft (rotational axle) of belt-suspending-tensioning roller) is determined by a main assembly of an image forming apparatus, whereas the angle of the belt surface is determined by the belt-suspending-tensioning roller of the belt unit. On the other hand, the angle of the optical sensor relative to the belt surface in terms of the direction indicated by the arrow mark θ is determined by the positioning plate attached to the main assembly of the image forming apparatus.

That is, the angle of the sensor of the reflection type relative to the belt surface is determined by a combination of the angle of the belt surface relative to the belt unit, and the angle between the positioning plate and sensor, including their deviation. Therefore, with the use of any of the conventional arts, it has been difficult to ensure that the angular deviation of the optical sensor relative to the belt surface in terms of the direction indicated by the referential mark θ remains minimum.

SUMMARY OF THE INVENTION

The present invention is characterized in that an image forming apparatus comprises a belt unit having an endless belt supported to be rotatable in a circumferential direction, an image forming unit for forming an image on the belt unit, and an optical sensor for detecting light projected onto the endless belt. The image forming apparatus further comprises a sensor supporting member for supporting the sensor, and a positioning portion including, as a unit, a first positioning portion for positioning the belt unit by being contacted by the belt unit and a second positioning portion positioning the sensor supporting member by being contacted by the sensor supporting member.

Figure 2:
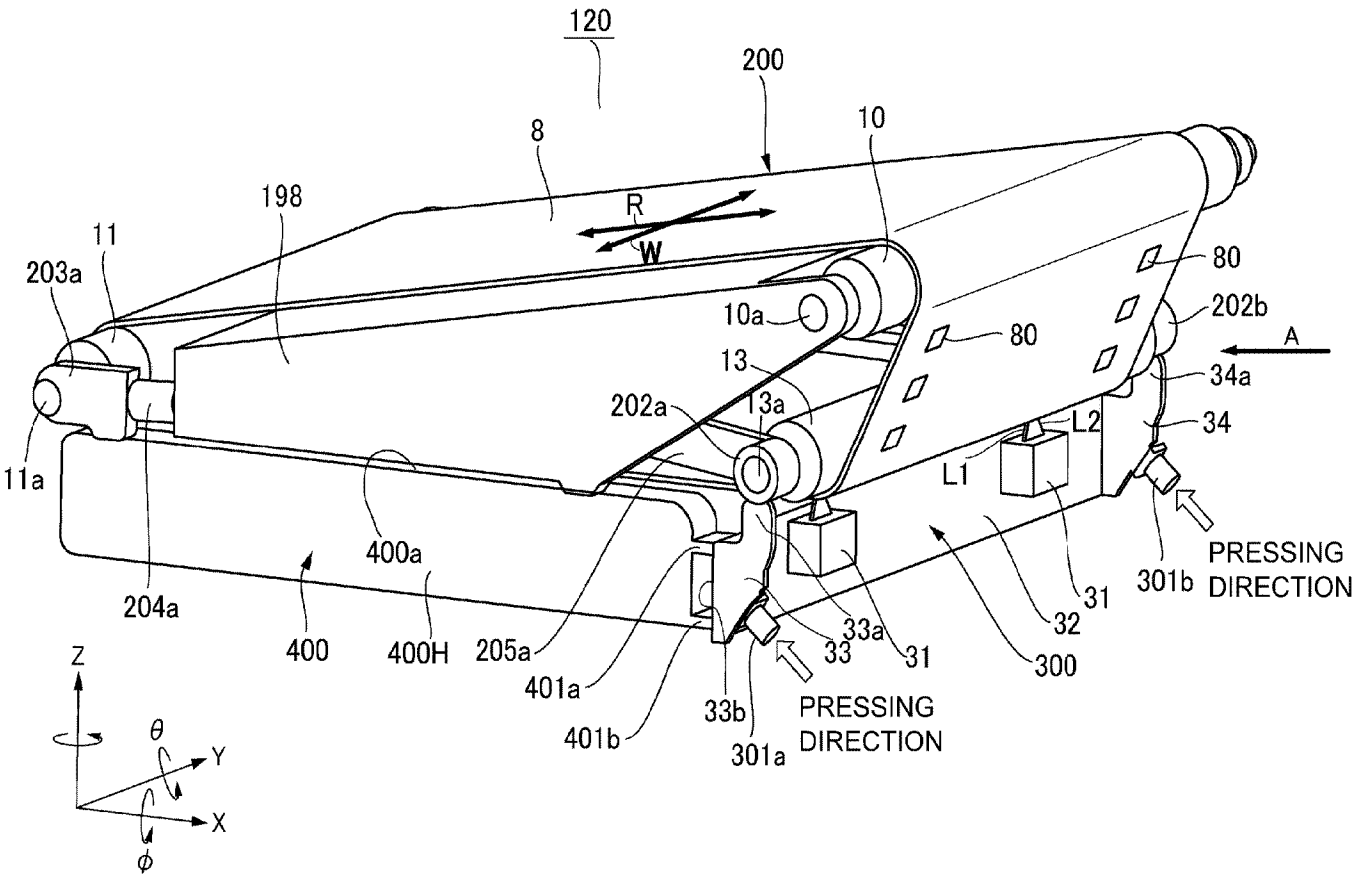
FIG. 2 is a perspective view of the entirety of a positioning device of the image forming apparatus shown in FIG. 1.
Figure 4:
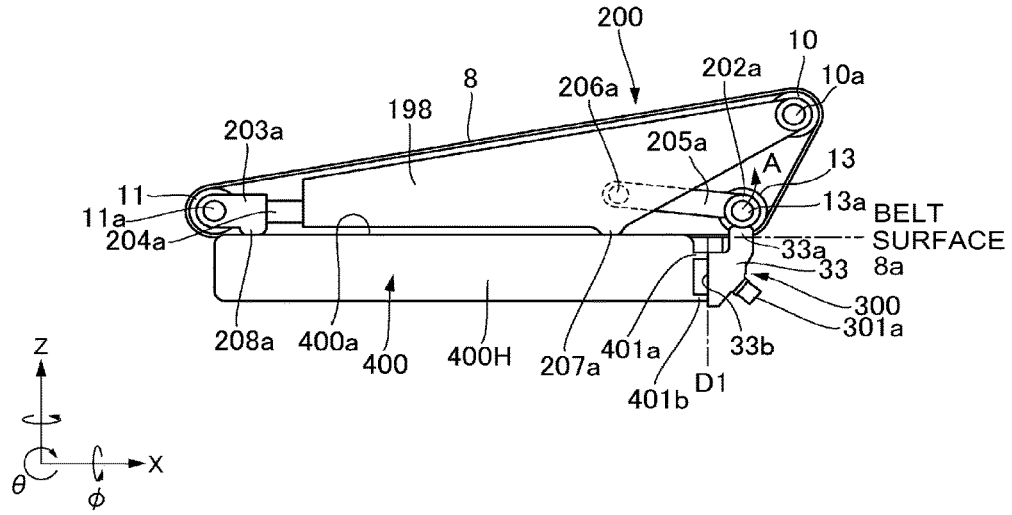
Figure 4:
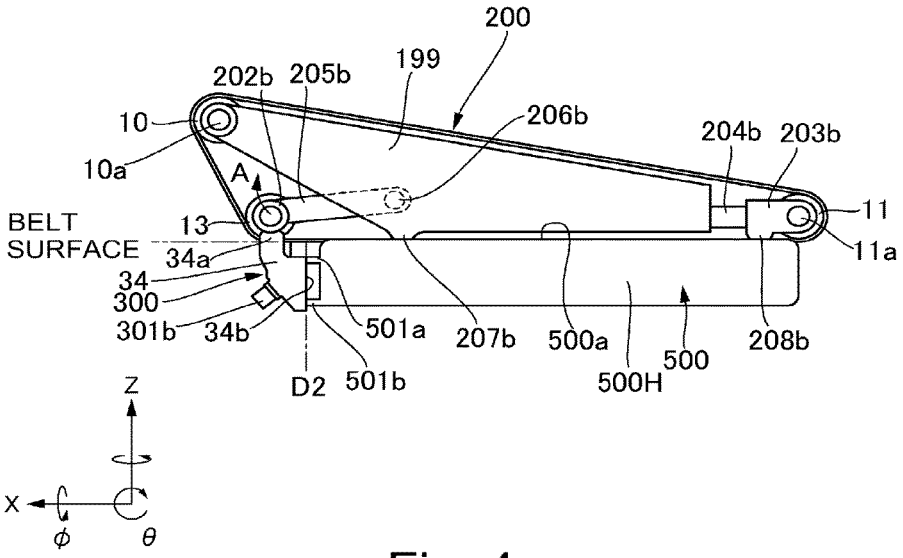

Part (a) of FIG. 4 is a front view of the positioning device shown in FIG. 2, and part (b) of FIG. 4 is a rear view of the positioning device shown in FIG. 2.

Figure 5:
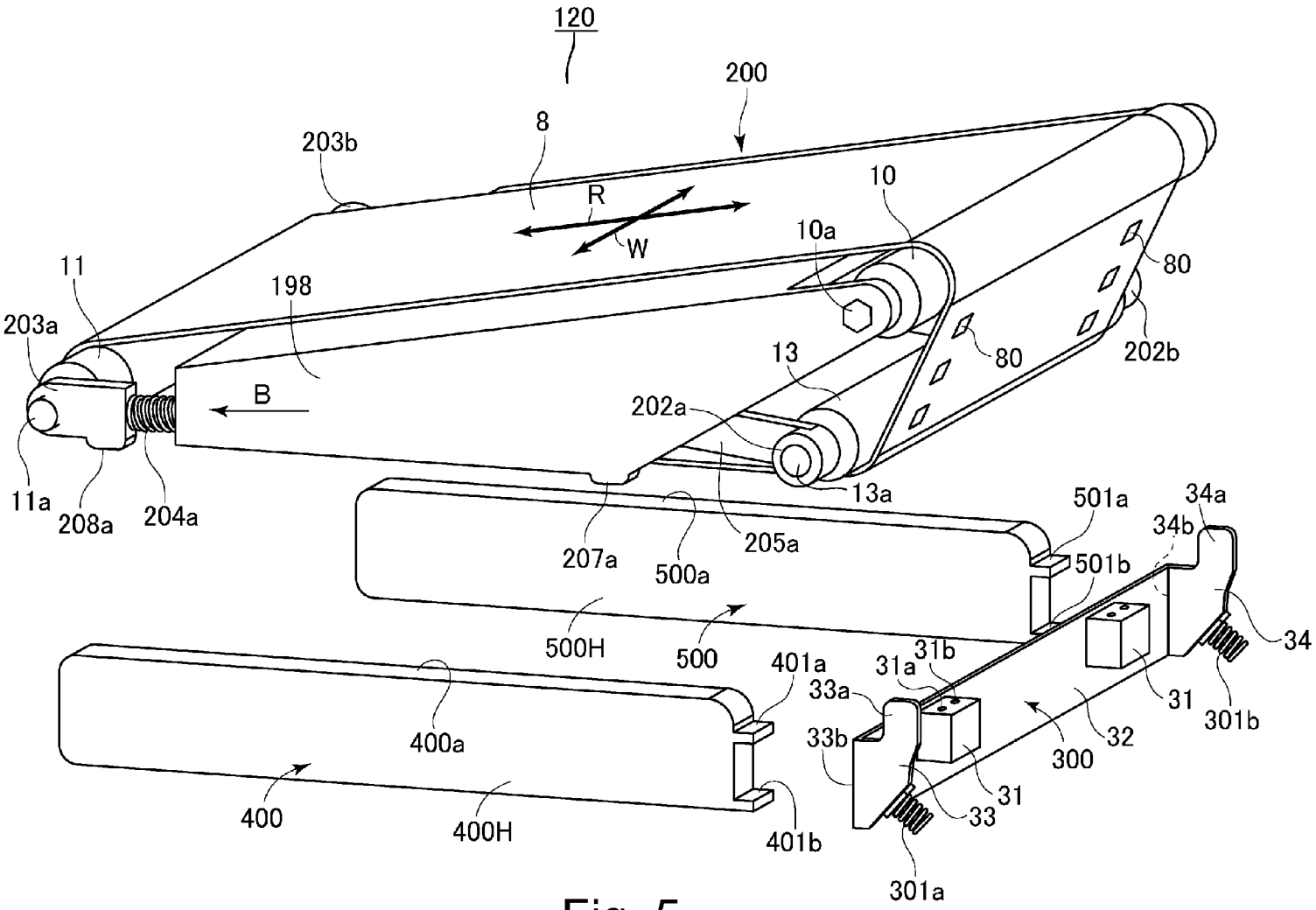

FIG. 5 is a partially exploded perspective view of the positioning device shown in FIG. 2.

Figure 6:
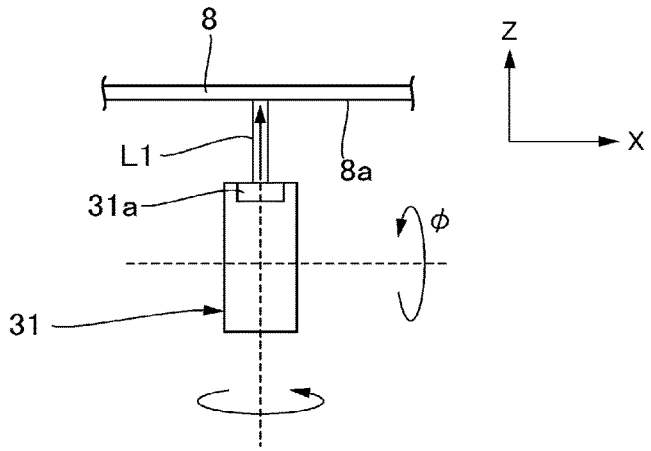
Figure 6:
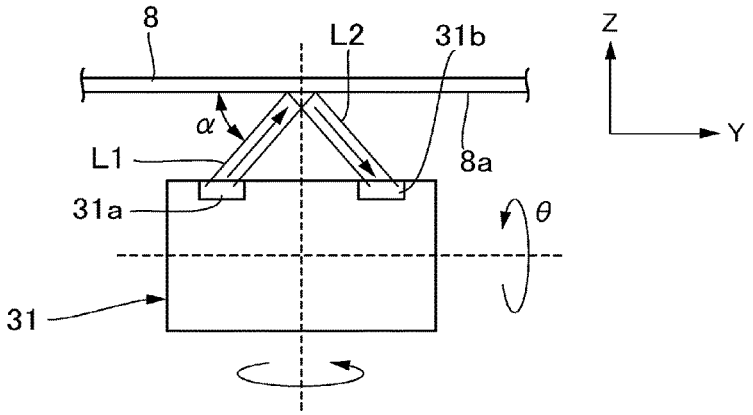

Parts (a) and (b) of FIG. 6 are drawings for describing the definition of a sensor attitude.

Figure 7:
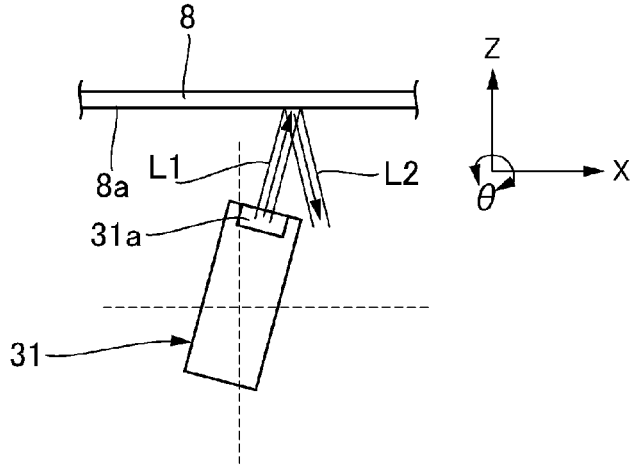
Figure 7:
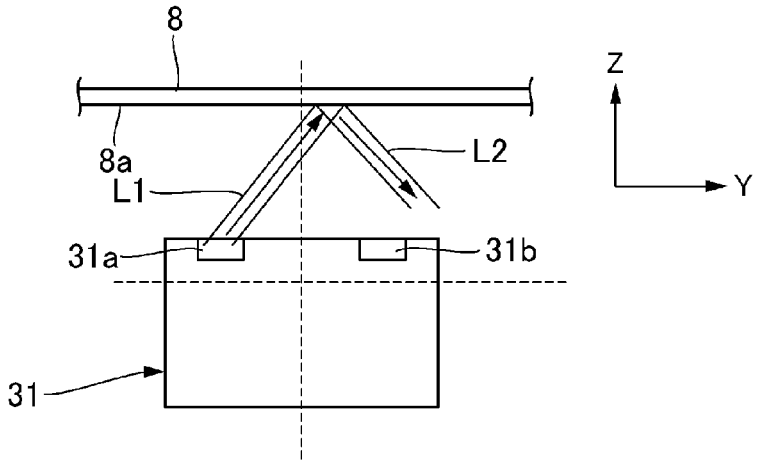
Figure 7:
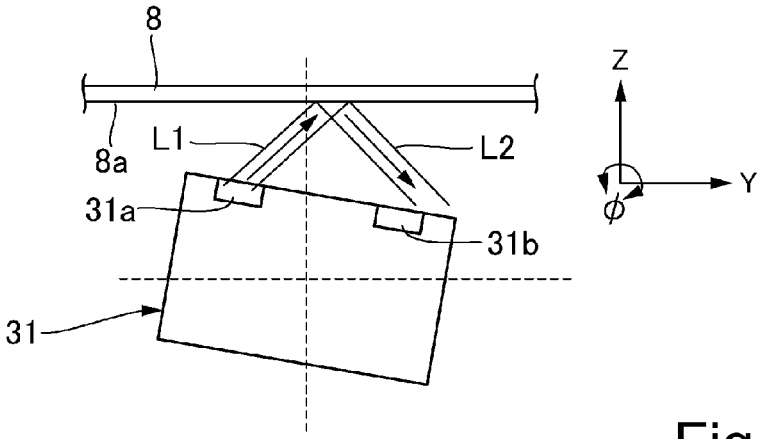

Part (a) of FIG. 7 is a schematic drawing of a sensor after the angular displacement of the sensor in the direction indicated by the arrow mark θ; part (b) of FIG. 7 is a schematic drawing of the sensor after the linear deviation of the sensor in the direction indicated by the arrow mark Z; and part (c) of FIG. 7 is a schematic drawing of the sensor after the angular deviation of the sensor in the direction indicated by the arrow mark ϕ.

DESCRIPTION OF THE EMBODIMENTS

Figure 1:
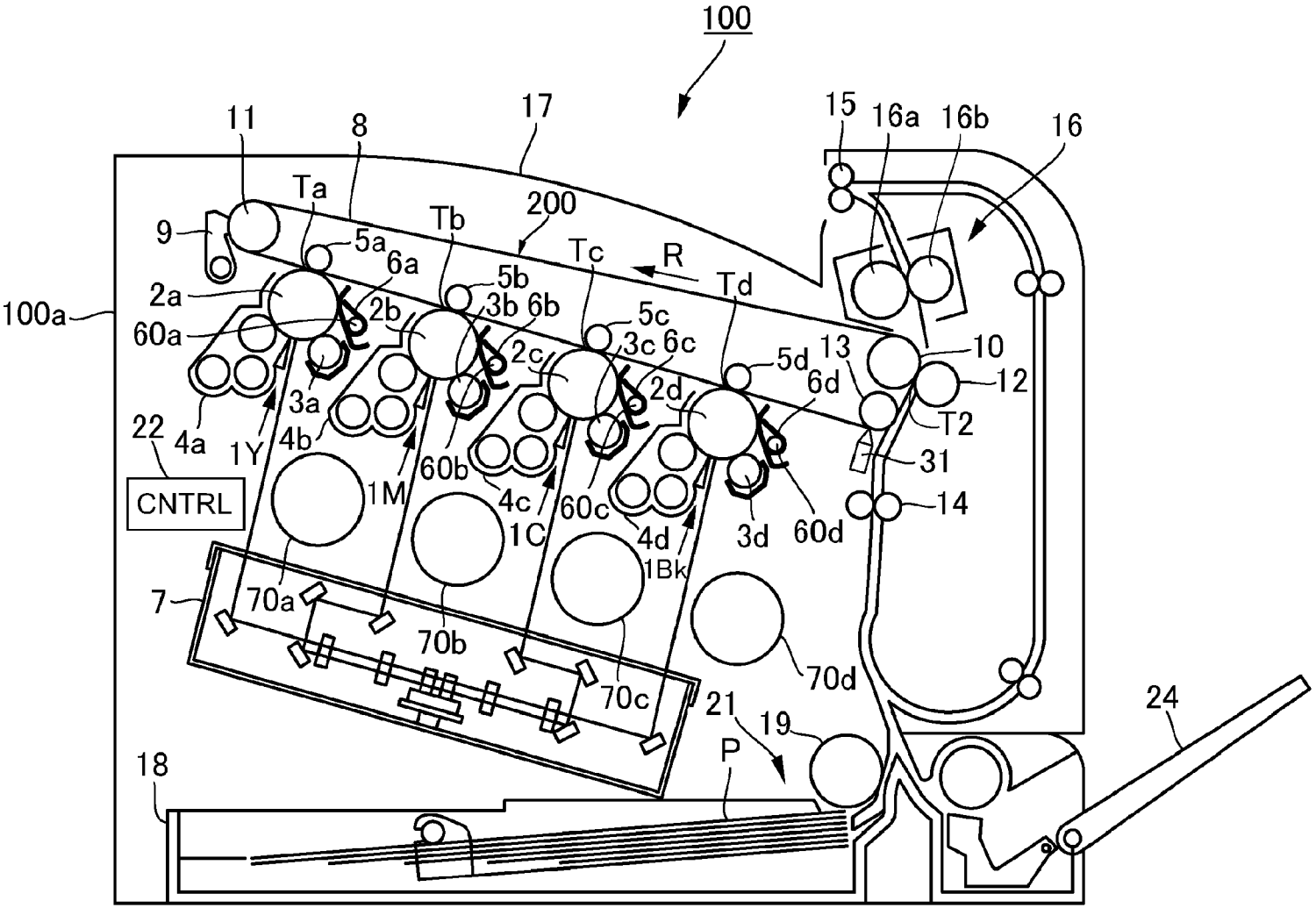
FIG. 1 is a schematic sectional view of the image forming apparatus in one of the preferred embodiments of the present invention; it shows the overall structure of the apparatus.

Hereinafter, one of the preferred embodiments of the present invention in the form of an image forming apparatus 100 is described with reference to appended drawings. By the way, if a given component, a section thereof, or the like, of the image forming apparatus 100 in a given drawing are the same in referential code as a given component, a section thereof, or the like, of the image forming apparatus 100 in another drawing, the former are the same as, or similar to, the latter. FIG. 1 is a schematic sectional view of the image forming apparatus 100 of the so-called intermediary transfer type, and also, of the so-called tandem type, for example, a digital full-color printer. It shows the general structure of the image forming apparatus 100. FIG. 5 is a partially exploded perspective view of a positioning device 120 of the image forming apparatus 100.

(Image Forming Apparatus 100)

The image forming apparatus 100 has an apparatus main assembly 100*a*. There is an intermediary transfer belt unit 200 as a belt unit, in the top portion of the apparatus main assembly 100*a*. Further, there are disposed four image forming sections 1Y, 1M, 1C and 1Bk, in the apparatus main assembly 100*a*. More specifically, the four image forming sections 1Y, 1M, 1C and 1Bk are aligned in tandem in the listed order, in the upstream-to-downstream direction in terms of the circular movement (counterclockwise direction in FIG. 1) of an intermediary transfer belt 8 as an endless belt, along the intermediary transfer belt 8, under the intermediary transfer belt unit 200. Moreover, there is disposed a controlling section 22, as a controlling means, which is equipped with a ROM, a RAM, and a CPU for controlling various sections of the image forming apparatus 100, in the apparatus main assembly 100*a*.

The image forming apparatus 100 is structured so that its image forming sections 1Y, 1M, 1C and 1Bk, which are image formation units for forming an image on the intermediary transfer belt 8, form yellow, magenta, cyan and black monochromatic toner images, respectively. The image forming sections 1Y, 1M, 1C and 1Bk are provided with electrophotographic photosensitive component metallic cores 2*a*, 2*b*, 2*c* and 2*d* (which will be referred to simply as "photosensitive drums"). The image forming apparatus 100 is structured so that these photosensitive drums 2*a*, 2*b*, 2*c* and 2*d* are rotationally driven in the clockwise direction of FIG. 1.

The intermediary transfer belt unit 200 (belt unit) is provided with a driver roller 10, an idler roller 13, and a tension roller 11, which are positioned in a preset relationship, and the intermediary transfer belt 8 which is an endless belt. The intermediary transfer belt 8 is suspended and kept tensioned by the three rollers 10, 13 and 11. That is, the intermediary transfer belt unit 200 has driver roller 10, tension roller 11, and idler roller 13, as belt-suspending-tensioning rollers, which support the intermediary transfer belt 8 so that the intermediary transfer belt 8 can be circularly moved in its circumferential direction (indicated by arrow mark R in FIG. 1 and FIG. 2).

Referring to FIG. 5, in the intermediary transfer belt unit 200, the axle 10*a* of the driver roller 10 is rotatably supported by one of the lengthwise ends of one of a pair of belt unit frames 198 and 199 (FIG. 3), and the corresponding end of the other belt frame. Further, the axle 11*a* of the tension roller 11 is rotatably supported at its lengthwise ends, by a pair of tension roller bearings 203*a* and 203*b* attached to the opposite end of the belt unit frames 198 and 199 from the driver roller 10, respectively. The intermediary transfer belt 8 is suspended by the combination of the driver roller 10, tension roller 11, and idler roller 13 in such a manner that the inward surface of the intermediary transfer belt 8 remains in contact with the peripheral surface of each of the three rollers 10, 11 and 13. Further, the tension roller 11 is kept under the pressure generated by a pair of tension roller springs 204*a* and 204*b* in the direction indicated by an arrow mark B, providing thereby the intermediary transfer belt 8 with tension.

Referring to FIG. 1, the intermediary transfer belt 8 is under the pressure applied thereto by primary transfer rollers 5*a*, 5*b*, 5*c* and 5*d*, as primary transferring means, from the inward side of the intermediary transfer belt 8 with reference to the loop (belt loop) which the intermediary transfer belt 8 forms. Thus, the outward surface of the intermediary transfer belt 8 remains in contact with the photosensitive drums 2*a*, 2*b*, 2*c* and 2*d*, in the image forming sections 1Y, 1M, 1C, and 1Bk. The intermediary transfer belt 8 remains tensioned leftward (in FIG. 1) by the tension roller 11. The intermediary transfer belt 8 is suspended by the combination of the tension roller 11, driver roller 10, and idler roller 13 in such a manner that the intermediary transfer belt 8 bridges between the adjacent two rollers in terms of the moving direction of the intermediary transfer belt 8, and can be rotationally driven in its circumferential direction (indicated by arrow mark R) by the rotation of the driver roller 10.

The primary transfer rollers 5*a*, 5*b*, 5*c* and 5*d* are on the inward side of the loop which the intermediary transfer belt 8 forms, and oppose the photosensitive drums 2*a*, 2*b*, 2*c* and 2*d*, forming thereby primary transfer nips Ta, Tb, Tc and Td, respectively, as primary transferring sections, between the photosensitive drums 2*a*, 2*b*, 2*c* and 2*d*, and the intermediary transfer belt 8. To each of the primary transfer rollers 5*a*, 5*b*, 5*c*, and 5*d*, positive DC voltage is applied as transfer bias from an unshown bias applying means. Thus, a negatively charged toner image borne on each of the photosensitive drums 2*a*, 2*b*, 2*c*, and 2*d* is transferred (primary transfer) onto the intermediary transfer belt 8 which is being conveyed through the primary transfer nips Ta, Tb, Tc, and Td.

As the driver roller 10, which doubles as a roller which opposes a secondary transfer roller 12, is rotated in the counterclockwise direction, the intermediary transfer belt 8 is rotated in the same direction by the rotation of the driver roller 10. The rotational speed of the intermediary transfer belt 8 is set to be roughly the same as the rotational speed (process speed) of each of the photosensitive drums 2*a*, 2*b*, 2*c*, and 2*d*.

There is disposed in the adjacencies of the peripheral surface of the photosensitive drum 2*a* (2*b*, 2*c* and 2*d*), a charge roller 3*a* (3*b*, 3*c* and 3*d*) as a charging means, and a developing device 4*a* (4*b*, 4*c* and 4*d*) as developing means, in the listed order in terms of the rotational direction of the photosensitive drum 2*a* (2*b*, 2*c*, and 2*d*). There is also disposed in the adjacencies of the peripheral surface of the photosensitive drum 2*a* (2*b*, 2*c* and 2*d*), the primary transfer roller 5*a* (5*b*, 5*c* and 5*d*), and a cleaning device 6*a* (6*b*, 6*c* and 6*d*), in the listed order in terms of the rotational direction of the photosensitive drum 2*a* (2*b*, 2*c* and 2*d*). Further, there is disposed on the underside of the combination of the image forming sections 1Y, 1M, 1C, and 1Bk, an exposing device 7 as a means for forming a latent image in each of the image forming sections 1Y, 1M, 1C, and 1Bk.

The charge roller 3*a* (3*b*, 3*c* and 3*d*) is rotated by the rotation of the photosensitive drum 2*a* (2*b*, 2*c* and 2*d*). As an oscillatory voltage, which is a combination of a negative DC voltage, and an AC voltage, is applied to the charge roller 3*a* (3*b*, 3*c* and 3*d*) while the photosensitive drum 2*a* (2*b*, 2*c* and 2*d*) is rotated, the charge roller 3*a* (3*b*, 3*c* and 3*d*) uniformly charges the photosensitive drum 2*a* (2*b*, 2*c* and 2*d*) to a negative polarity. The exposing device 7 writes an electrostatic image on the peripheral surface of each of photosensitive drums 2*a*, 2*b*, 2*c*, and 2*d*, by outputting a beam of laser light while modulating the beam according to image data obtained by separating an original (image to be formed) into monochromatic images of primary colors, and reflecting the beam with the use of a rotational mirror in such a manner that the beam scans the peripheral surface of the photosensitive drum 2*a* (2*b*, 2*c*, and 2*d*). The developing device 4*a* (4*b*, 4*c* and 4*d*) develops the electrostatic image on the photosensitive drum 2*a* (2*b*, 2*c* and 2*d*) into a visible image, that is, an image formed of toner (which hereafter will be referred to as "toner image"), by transferring toner onto the photosensitive drum 2*a* (2*b*, 2*c* and 2*d*).

There is disposed on the underside of the developing devices 4*a*, 4*b*, 4*c*, and 4*d*, toner bottles 70*a*, 70*b*, 70*c* and 70*d*, respectively. As the toner in the developing devices 4*a*, 4*b*, 4*c* and 4*d* is consumed by image formation, they are replenished with toner by the toner bottles 7*a*, 7*b*, 7*c*, and 7*d*, respectively.

The cleaning device 6*a* (6*b*, 6*c* and 6*d*) removes transfer residual toner, that is, the toner remaining on the peripheral surface of the photosensitive drum 2*a* (2*b*, 2*c*, and 2*d*) on the downstream side of the primary transfer nip Ta (Tb, Tc and Td), by rubbing the peripheral surface of the photosensitive drum 2*a* (2*b*, 2*c*, and 2*d*) with its cleaning blade. The removed toner is conveyed to an unshown toner outlet, by a toner conveyance screw 60*a* (60*b*, 60*c* and 60*d*), with which the cleaning device 6*a* (6*b*, 6*c* and 6*d*) is provided. Then, it is discharged through a toner outlet.

There is disposed the secondary transfer roller 12 in contact with the outward surface of the intermediary transfer belt 8, in such a manner that it opposes the driver roller 10. The secondary transfer roller 12 is positioned in such a manner that the intermediary transfer belt 8 is sandwiched between the intermediary transfer belt 8 and driver roller 10. The nip formed between the secondary transfer roller 12 and intermediary transfer belt 8 is the secondary transferring section T2.

The secondary transfer section T2 is formed by placing the secondary transfer roller 12 in contact with the intermediary transfer belt 8 in such a manner that the secondary transfer roller 12 opposes the driver roller 10 which is one of the rollers by which the intermediary transfer belt 8 is suspended and kept tensioned. The secondary transfer section T2 transfers the toner images formed on the intermediary transfer belt 8, onto a sheet P of recording medium sent from a recording feeding section 21. To the secondary transfer roller 12 of the secondary transferring section T2, a positive DC voltage is applied as the secondary transfer bias, whereby an electric field for transferring toner images is formed between the secondary transfer roller 12 and the grounded driver roller 10. As the secondary transfer bias is applied to the secondary transferring section T2 through the secondary transfer roller 12, the four monochromatic toner images, different in color, on the intermediary transfer belt 8 are transferred (secondary transfer) onto the sheet P of recording medium delivered to the secondary transferring section T2 by a pair of registration rollers 14.

Further, there is disposed a belt cleaning device 9, as a cleaning device of an intermediary transfer component, in contact with the portion of the outward surface of the intermediary transfer belt 8, which corresponds in position to the tension roller 11. The belt cleaning device 9 removes the transfer residual toner, that is, the toner remaining on the surface of the intermediary transfer belt 8 on the downstream side of the secondary transferring section T2 in terms of the moving direction of the intermediary transfer belt 8, by rubbing the surface of the intermediary transfer belt 8 with its cleaning blade (unshown).

On the downstream side of the secondary transferring section T2 in terms of the recording medium conveyance direction, a fixing device 16 having a fixation roller 16*a* and a pressure roller 16*b* is disposed. After the transfer of the toner images onto the sheet P of recording medium, the sheet P is conveyed to a fixation nip, which is between the fixation roller 16*a* and pressure roller 16*b*. In the fixation nip, heat and pressure are applied to the sheet P and the toner images thereon by the fixation roller 16*a* and pressure roller 16*b*. Thus, the toner images on the sheet P become fixed to the sheet P. Further, on the downstream side of the fixing device 16, a pair of discharge rollers 15 and a delivery tray 17 are disposed. By the way, a referential code 24 designates a manual feed tray.

There is disposed in the bottom portion of the apparatus main assembly 100*a*, the recording feeding section 21 having a sheet feeder cassette 18, in which sheets P of recording medium which are to be used for image formation are stored in layers. In the recording feeding section 21, the sheets P of recording medium in the sheet feeder cassette 18 are conveyed one by one toward the pair of registration rollers 14 by way of a separation roller 19. Then, each sheet P of recording medium is delivered to the secondary transferring section T2 with preset timing, by way of the pair of registration rollers 14. The separation roller 19 separates one by one the sheets P as it pulls out the sheets P from the sheet feeder cassette 18, and sends each sheet P toward the pair of registration rollers 14. The pair of registration rollers 14 catch each sheet P while remaining stationary. Then, they keep the sheet P on standby. Then, they send each sheet P to the secondary transferring section T2 with the same timing as the timing with which the toner images on the intermediary transfer belt 8 arrive at the secondary transferring section T2.

In the image forming apparatus 100 structured as described above, the toner images formed on the photosensitive drums 2*a*, 2*b*, 2*c*, and 2*d* are sequentially transferred (primary transfer) onto the intermediary transfer belt 8 while the intermediary transfer belt 8 is circularly moved in the counterclockwise direction. The transfer of the toner images from the photosensitive drums 2*a*, 2*b*, 2*c*, and 2*d* onto the intermediary transfer belt 8 is done by the application of the positive bias to the primary transfer rollers 5*a*, 5*b*, 5*c*, and 5*d*, respectively. The four toner images, different in color, layered on the intermediary transfer belt 8, as described above, are moved to the secondary transferring section T2.

Meanwhile, the toner remaining on the peripheral surface of the photosensitive drum 2*a* (2*b*, 2*c* and 2*d*) after the transfer of the toner image therefrom, is removed by the cleaning device 6*a* (6*b*, 6*c* and 6*d*). As for the toner remaining on the intermediary transfer belt 8 after the secondary transfer, it is removed by the belt cleaning device 9. The removed toner is recovered into a container for recovered toner, through a recovery toner conveyance passage (unshown).

Next, referring to FIGS. 6 and 7, the definition of sensor attitude, and the a changes in sensor attitude, are described. By the way, parts (a) and (b) of FIG. 6 are schematic drawings for describing the definition of the sensor attitude.

Part (a) of FIG. 7 is a schematic drawing of the sensor 31 of a reflection type, after the angular deviation of the sensor 31 in the direction indicated by a two-headed arrow mark θ, and part (b) of FIG. 7 is a schematic drawing of the sensor 31 of the reflection type, after the linear deviation of the sensor 31 in the direction indicated by an arrow mark Z. Part (c) of FIG. 7 is a schematic drawing of the sensor 31 of the reflection type, after the linear deviation of the sensor 31 in the direction indicated by a two-headed arrow mark ϕ.

To begin with, referring to parts (a) and (b) of FIG. 6, the sensor 31 of the reflection type, which is an optical sensor, is properly positioned relative to a surface 8*a* of the intermediary transfer belt 8, in terms of each of the directions X, Y and Z. That is, the sensor 31 of the reflection type, which detects the light projected upon the intermediary transfer belt 8, is properly held with respect to the direction indicated by the arrow mark ϕ (angle about axis X), direction indicated by the arrow mark θ (angle about axis Y), and direction Z. Thus, a beam L1 of light projected from a light emitting section 31*a* hits the surface 8*a* of the intermediary transfer belt 8 at a proper angle α, is reflected by the surface 8*a* at a proper angle, and is accurately caught by a light receiving section 31*b*.

In comparison, referring to part (a) of FIG. 7, if the sensor 31 of the reflection type (which hereafter will be referred to as reflection type sensor) angularly deviates in the direction θ, that is, the direction about axis X, the beam L1 projected from the light emitting section 31*a* is reflected by the surface 8*a* in a direction which is slightly different from the direction of the light receiving section 31*b*, failing therefore to be properly received by the light receiving section 31*b*. Further, referring to part (b) of FIG. 7, if the reflection type sensor 31 deviates in the direction Z (moves away from surface 8*a*), the beam L1 of light is reflected by the surface 8*a* at a position which is closer to the light receiving section 31*b* than the normal position, failing therefore to be properly received by the light receiving section 31*b*. Further, referring to part (c) of FIG. 7, if the reflection type sensor 31 tilts in the direction ϕ, that is, the direction about the axis X, the beam L1 of light is reflected by the surface 8*a* at a position which is closer to the light receiving section 31*b* than the normal position, failing therefore to be properly received.

(Details of Positioning Device 120)

Figure 3:
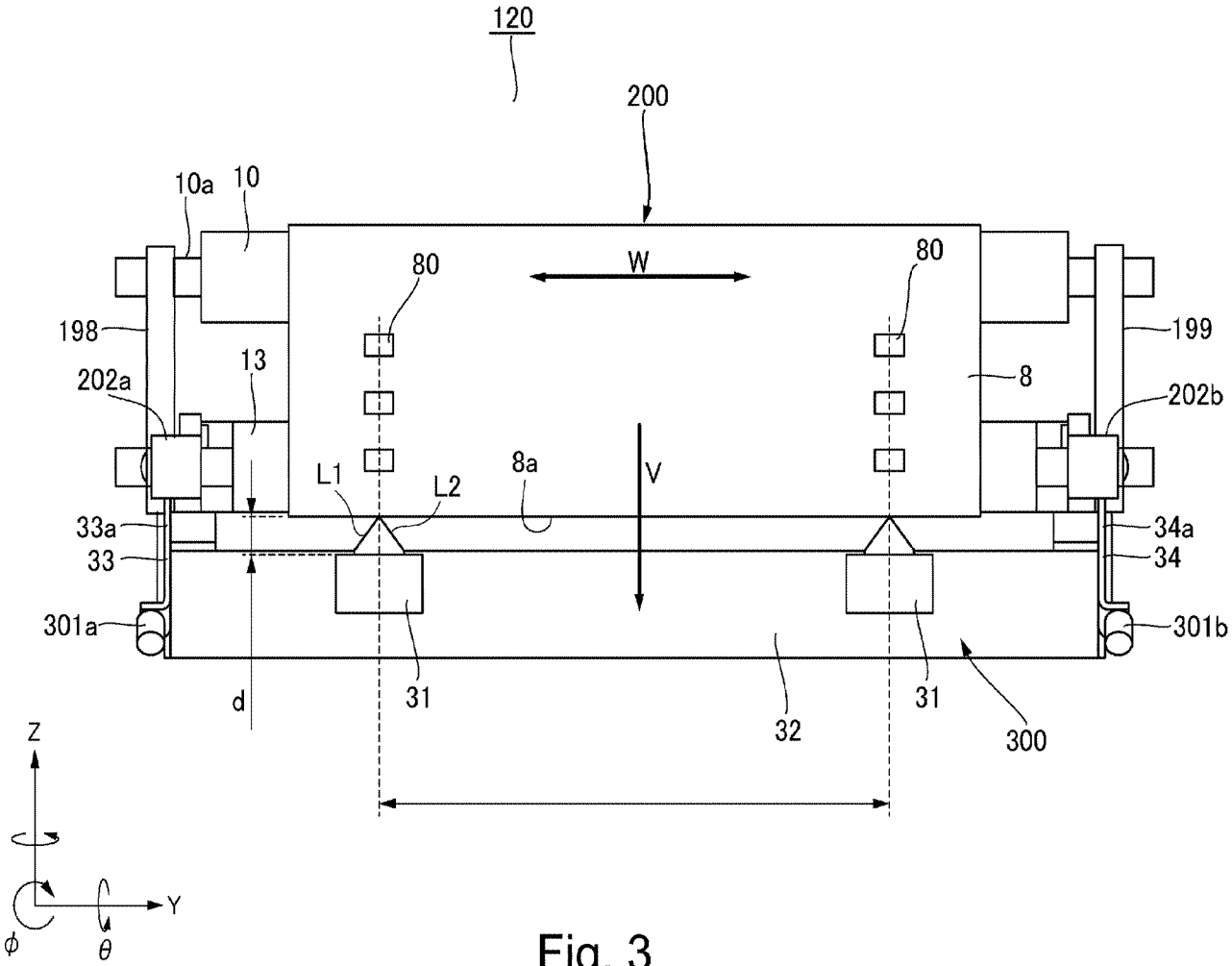
FIG. 3 is a side view of the positioning device, shown in FIG. 2, as seen from the direction indicated by an arrow A in FIG. 2.

Next, referring to FIGS. 2-5, the positioning device 120 in this embodiment, which makes it possible to prevent the reflection type sensor 31 from being improperly positioned as shown in parts (a)-(c) of FIG. 7, is described. By the way, FIG. 2 is a perspective view of the entirety of the positioning device 120, and FIG. 3 is a side view of the positioning device 120 as seen from the direction indicated by an arrow mark A in FIG. 2. Part (a) of FIG. 4 is a front view of the positioning device 120, and part (b) of FIG. 4 is a rear view of the positioning device 120.

The image forming apparatus 100 forms a test patch 80, which has a preset pattern, on the intermediary transfer belt 8, with the use of the image forming sections 1Y, 1M, 1C and 1Bk which are in the form of a drum cartridge, with preset timing. The test patch 80 having the preset pattern is formed on the intermediary transfer belt 8 through the same process as the normal process for forming an image, in order to detect the density deviation, positional (color) deviation, and toner image formation timing.

As the test patch 80 is detected by the reflection type sensor 31 as a sensor, the control section 22 carries out the control for optimizing the image forming apparatus 100 in the density of the toner image formed by each of the image forming sections 1Y, 1M, 1C and 1Bk, and the timing with which the toner image is formed by each of the image forming sections 1Y, 1M, 1C and 1Bk, based on the information obtained by the detection. The reflection type sensor 31 has the light emitting section 31*a* (FIG. 5) which emits the beam L1 of light, and the light receiving section 31*b* (FIG. 5) which catches a beam L2 of light, that is, the beam L1 reflected by the intermediary transfer belt 8.

Next, a density detection test patch formed as the test patch 80 in this embodiment, and how the density is detected by the reflection type sensor 31 in this embodiment, are described.

Referring to FIG. 3, the positioning device 120 is provided with a pair of reflection type sensors 31, which are positioned so that they align in the widthwise direction of the intermediary transfer belt 8 (front-rear direction of apparatus), with the provision of a preset amount of distance between the pair of reflection type sensors 31, and also, so that their position coincides with the position of the test patch 80. The reflection type sensors 31 are disposed on the underside of the intermediary transfer belt 8, being positioned directly below the idler roller 13, with the provision of a preset distance d between the reflection type sensors 31 and surface 8*a* of the intermediary transfer belt 8.

Next, referring to FIGS. 2, 3 and 5, the pair of reflection type sensors 31 are parts of a sensor unit 300, and are fixed to a sensor unit frame 32 as a sensor supporting component, being aligned in the widthwise direction of the intermediary transfer belt 8 as described above. The two reflection type sensors 31 are the same in structure. The sensor unit frame 32 has: surfaces 33*b* and 34*b* as first positioning sections, and protrusive sections 33*a* and 34*a* as second positioning sections.

That is, the sensor unit frame 32 is positioned so that its lengthwise direction becomes parallel to the widthwise direction (indicated by arrow mark W) of the intermediary transfer belt 8. The lengthwise ends of the sensor unit frame 32 are provided with a pair of bent sections 33 and 34, one for one, which are perpendicular to the main section of the sensor unit frame 32, and have protrusive sections 33*a* and 34*a*, and surfaces 33*b* and 34*b*, respectively. The two reflection type sensors 31 are fixed to the sensor unit frame 32, close to the lengthwise ends of the sensor unit frame 32, one for one. Therefore, the test patches 80 can be positioned relative to the surface 8*a* of the intermediary transfer belt 8 with a high level of accuracy. The surface 33*b* as the first positioning section remains in contact with sensor positioning protrusions 401*a* and 401*b* as the second positioning section, whereas the surface 34*b* as the first positioning section remains in contact with sensor positioning protrusions 501*a* and 501*b* as the second positioning section. The sensor positioning protrusions 401*a*, 401*b*, 501*a* and 501*b* position the sensor unit frame 32 by remaining in contact with the sensor unit frame 32.

The sensor unit 300 is also provided with a pair of pressure application springs 301*a* and 301*b* such as compression springs as pressure applying means for pressing the sensor unit frame 32. It is structured so that a combination of the protrusive section 33*a*, and a combination of surfaces 33*b* and surface 34*b* remain pressured diagonally upward in the left-to-right direction from the bottom-right portion of FIG. 2. The sensor unit 300 is supported by an unshown supporting means in such a manner that it is allowed to move in the direction which is parallel to the direction in which pressure is applied by the pressure application springs 301*a* and 301*b*. However, the movement of the sensor unit frame 32 is regulated by the abovementioned supporting means so that even when the idler roller 13 retreats upward as will be described later, the sensor unit frame 32 which is under the pressure generated by the pressure application springs 301*a* and 301*b* does not move upward beyond a preset level.

That is, the pressure application springs 301*a* and 301*b* press the sensor unit frame 32 so that the surface 33*b* remains in contact with the sensor positioning protrusions 401*a* and 401*b*; the surface 34*b*, in contact with the sensor positioning protrusions 501*a* and 501*b*; and protrusive sections 33*a* and 34*a* remain in contact with bearings 202*a* and 202*b*. The sensor unit frame 32 is pressed by the opposite lengthwise end of each of the pressure application springs 301*a* and 301*b*, from the lengthwise end by which the pressure application springs 301 are supported by the apparatus main assembly 100*a*.

The bearings 202*a* and 202*b* which are parts of the intermediary transfer belt unit 200 make up the supporting sections. These supporting sections support axle 13*a* of the idler roller 13 which is one of the belt-suspending-tensioning rollers and is in the adjacencies of the sensor positioning protrusions 401*a*, 401*b*, 501*a* and 501*b*.

The sensor positioning protrusions 401*a* and 401*b* are parts of a positioning component 400, and protrude from a main section 400H of the positioning component 400. The sensor positioning protrusions 501*a* and 501*b* are parts of a positioning component 500, and protrude from a main section 500H of the positioning component 500. Further, the sensor positioning protrusions 401*a* and 501*a* are the first positioning protrusions, and the positioning protrusions 401*b* and 501*b* are the second positioning protrusions. Further, an interface D1 (part (a) of FIG. 4), which will be described later, coincides with the end surface of each of the sensor positioning protrusions 401*a* and 401*b*, and an interface D2 (part (b) of FIG. 4), coincides with the end surface of each of the sensor positioning protrusions 501*a* and 501*b*.

The positioning components 400 and 500 are fixed to preset positions in the apparatus main assembly 100*a* (FIG. 1). Referring to FIG. 5, the intermediary transfer belt unit 200 is positioned by being placed in contact with positioning surfaces 400*a* and 500*a*, as the first positioning sections, which are the top surfaces of the positioning components 400 and 500, respectively. That is, these positioning surfaces 400*a* and 500*a* position the intermediary transfer belt unit 200 as the intermediary transfer belt unit 200 is placed in contact with them, respectively.

The positioning components 400 and 500 are disposed on the front and rear sides, respectively, of the intermediary transfer belt unit 200 in terms of the widthwise direction (indicated by arrow mark W) which is intersectional (perpendicular) to the circumferential direction (indicated by arrow mark R) of the intermediary transfer belt 8. Thus, the intermediary transfer belt unit 200 can be mounted on the positioning surfaces 400*a* and 500*a* while remaining in balance in terms of the widthwise direction (W).

Referring to parts (a) and (b) of FIG. 4, the intermediary transfer belt unit 200 has protrusive sections 207*a*, 208*a*, 207*b* and 208*b* as positioning sections, which are placed in contact with the above-described positioning surfaces 400*a* and 500*a*.

That is, in order to control the intermediary transfer belt unit 200 in attitude in terms of the direction θ, the positioning component 400 has the positioning surface 400*a*, with which the protrusive section 207*a* of the belt unit frame 198 and the protrusive section 208*a* of tension roller bearing 203*a*, are placed in contact. In order to control the intermediary transfer belt unit 200 in attitude in terms of the direction θ, the positioning component 500 has the positioning surface 500*a*, with which the protrusive section 207*b* of the belt unit frame 199, and the protrusive section 208*b* of tension roller bearing 203*b*, are placed in contact.

Thus, the protrusive sections 207*a* and 207*b* of the belt unit frames 198 and 199, respectively, and the protrusive sections 208*a* and 208*b* of the tension roller bearings 208*a* and 203*b*, respectively, contact the positioning surfaces 400*a* and 500*a*, respectively. Therefore, the belt unit frame 198 and belt unit frame 199 are controlled in position in terms of the direction Z, and also, in angle in terms of the direction θ. Therefore, the surface 8*a* of the intermediary transfer belt 8 which is suspended and kept tensioned by the driver roller 10, tension roller 11, and idler roller 13 which are in connection to the frames 198 and 199, is controlled in angle in terms of the direction θ.

Further, the protrusive sections 33*a* and 34*a* control the sensor unit 300 in position in terms of the direction which is roughly parallel to the interfaces D1 and D2. Each of the sensor positioning protrusions 401*a* and 401*b* has a surface which coincides with the above-described interface D1, and contacts the sensor unit frame 32 which is under the pressure generated by the pressure application springs 301*a* and 301*b*. Further, each of the sensor positioning protrusions 501*a* and 501*b* has a surface which coincides with the above-described interface D2, and contacts the sensor unit frame 32 which is under the pressure generated by the pressure application springs 301*a* and 301*b*.

The intermediary transfer belt unit 200 is structured so that the interfaces D1 and D2 become roughly perpendicular to the surface 8*a* of the intermediary transfer belt 8, which the reflection type sensors 31 face. That is, referring to part (a) of FIG. 4, the intermediary transfer belt unit 200 is structured so that the interface D1, which coincides with the end surface of sensor positioning protrusion 401*a*, and the end surface of the sensor positioning protrusion 401*b*, becomes roughly perpendicular to the surface 8*a* of the intermediary transfer belt 8, as seen from the front-to-rear direction (direction Y) in part (a) of FIG. 4. Referring to part (b) of FIG. 4, the intermediary transfer belt unit 200 is structured so that the interface D2 which coincides with the end surface of the sensor positioning protrusion 501*a* and 501*b*, becomes roughly perpendicularly and intersects with the surface 8*a*. Therefore, the intermediary transfer belt unit 200 in this embodiment is more stable and better in the level of accuracy with which the test patch 80 is detected than any conventional intermediary transfer belt unit.

With the provision of the above-described structural arrangement, the protrusive sections 33*a* and 34*a* of the sensor unit frame 32 remain in contact with the bearings 202*a* and 202*b*, respectively, and the surfaces 33*b* and 34*b* of the sensor unit frame 32 remain in contact with the sensor positioning protrusions 401*a* and 401*b* and the sensor positioning protrusions 501*a* and 501*b*, respectively. Thus, the sensor unit frame 32 is accurately positioned relative to the surface 8*a* of the intermediary transfer belt 8, with reference to the positioning components 400 and 500.

As described above, the positioning components 400 and 500 have the positioning surfaces 400*a* and 500*a* as the first positioning sections, and sensor positioning protrusions 401*a*, 401*b*, 501*a* and 501*b*. Therefore, the positioning components 400 and 500 function as shared positioning sections for both the intermediary transfer belt unit 200 and sensor unit frame 32, while remaining fixed to the apparatus main assembly 100*a*. Therefore, the intermediary transfer belt unit 200 in this embodiment is substantially higher in the level of accuracy with which the reflection type sensors 31 are positioned relative to the intermediary transfer belt 8 than any conventional intermediary transfer belt unit.

The positioning surfaces 400*a* and 500*a* as the first positioning sections control the position of the intermediary transfer belt unit 200 in terms of vertical direction (indicated by arrow mark V in FIG. 3), and the interfaces D1 and D2 are formed to be roughly parallel to the vertical direction. Therefore, the positional relationship between the surface 8*a* of the intermediary transfer belt 8 and the reflection type sensor 31 is maintained at a high level of accuracy.

In this embodiment, the idler roller 13 is attached to pivotal bearings 205*a* and 205*b* attached to the belt unit frames 198 and 199. The intermediary transfer belt unit 200 is structured so that the belt unit frame 198 and 199 can be slid out of the apparatus main assembly 100*a*, along with the intermediary transfer belt unit 200, in the direction indicated by the arrow mark X in part (a) of FIG. 4, when the intermediary transfer belt unit 200 reaches the end of its life span, or it needs to be replaced due to the occurrence of unexpected malfunction or the like. In order to allow the intermediary transfer belt unit 200 to be slid out of the apparatus main assembly 100*a*, the sensor unit 300 and intermediary transfer belt unit 200 need to be separated from each other. Therefore, the idler roller 13 is supported in such a manner that it can be pivotally moved about pivots 206*a* and 206*b* of the belt unit frame 198 and 199, respectively, in the direction indicated by the arrow mark A in parts (a) and (b) of FIG. 4.

As described above, the angular deviation of the reflection type sensor 31 relative to the surface 8*a* of the intermediary transfer belt 8 in terms of the direction θ is as follows. That is, it is a combination of the angular deviation of the protrusive sections 207*a*, 208*a*, 207*b* and 208*b* which control the surface 8*a* and intermediary transfer belt unit 200 in attitude, and the accuracy of the positioning components 400 and 500. Therefore, it is minimized that the angle (attitude) of the reflection type sensor 31 relative to the surface 8*a* is affected by the inaccuracy of the apparatus main assembly 100*a* and the components thereof in terms of size and shape.

Further, because the sensor unit frame 32 is directly in contact with the bearings 202*a* and 202*b* for the idler roller 13, the distance between the intermediary transfer belt 8 and reflection type sensor 31 is unlikely to be affected by the inaccuracy in the shape and size of the components other than the pivotal bearings 205*a* and 205*b*. Therefore, the inaccuracy in the preset distance d (FIG. 3) between the reflection type sensor 31 and surface 8*a* of the intermediary transfer belt 8 remains very small. Therefore, both the angle of the reflection type sensor 31 relative to the surface 8*a* of the intermediary transfer belt 8 in terms of the direction θ, and the distance between the reflection type sensor 31 and surface 8*a* in terms of the direction Z, are unlikely to substantially deviate, regardless of the tolerance in the components of the apparatus main assembly 100*a*.

Therefore, in the case of the image forming apparatus 100, it is ensured that the test patches 80 which are formed on the intermediary transfer belt 8 by the image forming sections 1Y, 1M, 1C and 1Bk are accurately detected by the reflection type sensors 31 which remain highly precisely positioned as described above. The information obtained by the detection of the test patches 80 is sent to the control section 22 (FIG. 1). The control section 22 compares the information with referential values, and sends control signals which correspond to the necessary amount of correction, to the devices, components and sections thereof which are to be controlled, to control them. Thus, the image forming sections 1Y, 1M, 1C and 1Bk are optimized in the density of the toner images they form.

By the way, in this embodiment, the test patches 80 for detecting image density are formed on the intermediary transfer belt 8, and are detected by the reflection type sensors 31. However, this embodiment is not intended to limit the present invention in scope. That is, the image forming apparatus 100 may be structured so that test patches for positional deviation (color deviation) are formed on the intermediary transfer belt 8, and are detected by the reflection type sensors 31.

Further, the image forming apparatus 100 may be structured so that both the test patches 80, and the patches for detecting positional deviation (unshown), are formed on the intermediary transfer belt 8, and are detected by reflection type sensors 31 dedicated to the test patches 80, and the reflection type sensors dedicated to the test patches for detecting positional deviation. In other words, this embodiment is not intended to limit the present invention in terms of the number, usage, position, and the like, of the reflection type sensors 31 to be attached to the sensor unit frame 32, and also, in terms of the pattern in which the test patches 80, and the test patches for detecting positional deviation (unshown), are formed.

Moreover, in this embodiment, the image forming apparatus 100 is provided with four image forming sections 1Y, 1M, 1C and 1Bk. However, this embodiment is not intended to limit the present invention in scope. That is, the present invention is also applicable to an image forming apparatus having one image formation unit comprising one photosensitive drum, and four developing devices disposed in the adjacencies of the peripheral surface of the photosensitive drum.

Furthermore, in this embodiment, the test patches 80 are formed on the intermediary transfer belt 8. However, the present invention is also applicable to an image forming apparatus which forms the test patches 80 on its sheet conveyance belt, with the same effects as those described above.

According to this embodiment, the angle of the sensor unit 300 in terms of the direction θ is controlled by the positioning components 400 and 500 which controls the attitude of the intermediary transfer belt unit 200. Therefore, the angular deviation of the sensor unit 300 relative to the intermediary transfer belt 8, in terms of the direction θ, which is attributable to the inaccuracy of the components of the intermediary transfer belt unit 200, can be extremely effectively minimized.

Further, the bearings 202*a* and 202*b* are directly placed in contact with the sensor unit frame 32 in terms of the direction Z. Therefore, the bearings 202*a* and 202*b* are positioned without being affected by the accuracy of the positioning components 400 and 500, and the other components of the intermediary transfer belt unit 200 than the sensor unit frame 32. Therefore, the image forming apparatus 100 in this embodiment is superior to any conventional image forming apparatus in terms of the level of accuracy with which the combination of the apparatus main assembly 100*a* and intermediary transfer belt unit 200 is corrected in color deviation. That is, this embodiment (present invention) can provide an image forming apparatus (100) which affords more latitude for the color deviation and density deviation which are attributable to the environmental changes, and repetition of image formation (cumulative length of usage of image forming sections).

As described above, in this embodiment, positioning of the intermediary transfer belt unit 200 and sensor unit frame 32 (sensor unit 300) relative to each other is done by pressing sensor unit 300 diagonally upward from the bottom right end of the sensor unit 300 through the positioning components 400 and 500. Further, referring to part (a) of FIG. 4, the angle of the reflection type sensor 31 in terms of the direction θ is properly controlled by placing sensor unit frame 32 in contact with the sensor positioning protrusions 401*a* 401*b*, 501*a* and 501*b*. Moreover, the sensor unit frame 32 is also placed in contact with the bearings 202*a* and 202*b* for the idler roller 13. Therefore, the distance between the reflection type sensor 31 and intermediary transfer belt 8 in terms of the direction Z is properly controlled by the protrusive sections 33*a* and 33*b*.

Therefore, the angle of the beams L1 and L2 of light emitted by the reflection type sensor 31, relative to the surface 8*a* of an endless belt such as the intermediary transfer belt 8, sheet conveyance belt, and the like, is precisely controlled. Further, it is ensured that the test patches 80 formed on an endless belt such as the intermediary transfer belt 8 are precisely detected by the reflection type sensors 31.

INDUSTRIAL APPLICABILITY

According to the present invention, the angle of a sensor relative to an endless belt can be precisely controlled. Therefore, it is possible to provide an image forming apparatus which can precisely detect test patches with its sensor.

The invention claimed is:

1. An image forming apparatus comprising:

a belt unit including an endless belt capable of traveling around a plurality of stretching rollers supporting said endless belt;

an image forming unit configured to form a toner image on said belt;

a sensor unit including a sensor including a light emitting portion and a light receiving portion and configured to detect light from said belt;

a setting portion configured to set an image forming condition of said image forming unit in accordance with an output of said sensor; and a positioning member including a first portion-to-be-contacted contacting at least one end portion of said belt unit with respect to a widthwise direction crossing with a moving direction of said belt at a plurality of positioning places and a second portion-to-be-contacted contacting at least one end portion of said sensor unit with respect to the widthwise direction at a plurality of positioning places.

2. An apparatus according to claim 1, wherein said positioning member is disposed at each of the end portions with respect to the widthwise direction.

3. An apparatus according to claim 1, further comprising a supporting member extending in the widthwise direction to support said sensor, wherein said supporting member is positioned by contacting said positioning member.

4. An apparatus according to claim 1, wherein said belt unit includes a stretching roller supporting member for supporting said plurality of stretching rollers, and said stretching roller supporting member is positioned by contacting said positioning member.

5. An apparatus according to claim 1, wherein the light from said light emitting portion is projected onto a flat surface portion of said belt adjacent a first stretching roller of said plurality of stretching rollers, and a plane including a line connecting said light emitting portion and said light receiving portion and a position of said belt where the light is projected is perpendicular to the flat surface portion.

6. An apparatus according to claim 1, wherein said belt unit is detachably mountable relative to a main assembly of said apparatus.

7. An apparatus according to claim 6, wherein the positioning places of said first portion-to-be-contacted are arranged substantially in a horizontal direction, and said belt unit is mounted and dismounted relative to the main assembly of said apparatus substantially in the horizontal direction.

8. An apparatus according to claim 6, wherein the positioning places of said second portion-to-be-contacted are arranged substantially in a vertical direction.

9. An apparatus according to claim 6, wherein said sensor unit is movable, and wherein said apparatus further comprises an urging member for urging said sensor unit toward said positioning member in a state that said belt unit is mounted to the main assembly of said apparatus.

10. An apparatus according to claim 9, wherein said urging member urges said sensor unit toward said positioning member and toward a supporting portion supporting a first stretching roller of said plurality of stretching rollers.

11. An image forming apparatus comprising:

a belt unit, including an endless belt, a plurality of stretching rollers, and a stretching roller supporting member, said belt unit being detachably mountable relative to a main assembly of said apparatus, the belt being capable of traveling around the stretching rollers, the stretching rollers, including an opposing roller, supporting the endless belt, the stretching roller supporting member, including a first contacting portion and a third portion-to-be-contacted, to support the plurality of stretching rollers, the third portion-to-be-contacted being disposed where the opposing roller is supported, as viewed in a direction of a rotational axis of the opposing roller;

an image forming unit configured to form a toner image on the belt;

a sensor unit including a sensor and a sensor supporting member, the sensor including a light emitting portion and a light receiving portion to detect light from the belt adjacent to the opposing roller, the sensor supporting member including a second contacting portion and a third contacting portion to support the sensor so as to be movable in the main assembly;

a controller configured to control an image forming condition of said image forming unit in accordance with an output of the sensor;

a positioning member, including a first portion-to-be-contacted and a second portion-to-be-contacted, configured to position the stretching roller supporting member and the sensor supporting member, the first portion-to-be-contacted being contactable to the first contacting portion, and the second portion-to-be-contacted being contactable to the second contacting portion; and an urging member configured to urge the sensor supporting member toward the third portion-to-be-contacted and the second portion-to-be-contacted in a state that said belt unit is mounted to the main assembly and the first contacting portion contacts the first portion-to-be-contacted, so that the third contacting portion contacts the third portion-to-be-contacted and the second contacting portion contacts the second portion-to-be-contacted.

12. An apparatus according to claim 11, wherein said positioning member is disposed at each of end portions with respect to a widthwise direction crossing with a moving direction of the belt.

13. An apparatus according to claim 11, wherein the first contacting portion contacts the first portion-to-be-contacted at plural positions.

14. An apparatus according to claim 13, wherein the second contacting portion contacts the second portion-to-be-contacted at plural positions.

15. An apparatus according to claim 11, wherein the first portion-to-be-contacted determines a position of the stretching roller supporting member in a first direction, and the second portion-to-be-contacted determines a position of the sensor supporting member in a second direction crossing with the first direction.

16. An apparatus according to claim 15, wherein the first direction is substantially a vertical direction, and said belt unit is mounted and dismounted relative to the main assembly substantially in a horizontal direction.

17. An apparatus according to claim 15, wherein the third contacting portion determines a position of the stretching roller supporting member by contacting the third portion-to-be-contacted.

18. An apparatus according to claim 15, wherein as viewed in the direction of the rotational axis of the opposing roller, a length of said positioning member along the second direction is longer than a length of said positioning member along the first direction.

* * * * *